US012623158B2

(12) United States Patent
Guo

(10) Patent No.: US 12,623,158 B2
(45) Date of Patent: May 12, 2026

(54) ELECTRIC SQUISHY MAKER

(71) Applicant: NINGBO HENGYING TOYS INDUSTRIAL CO., LTD., Ningbo (CN)

(72) Inventor: Jian Guo, Ningbo (CN)

(73) Assignee: NINGBO HENGYING TOYS INDUSTRIAL CO., LTD., Ningbo (CN)

( * ) Notice: Subject to any disclaimer, the term of this patent is extended or adjusted under 35 U.S.C. 154(b) by 0 days.

(21) Appl. No.: 19/183,690

(22) Filed: Apr. 18, 2025

(65) Prior Publication Data

US 2025/0242272 A1 Jul. 31, 2025

(30) Foreign Application Priority Data

Apr. 8, 2025 (CN) ..... 202510436159.6

(51) Int. Cl.
*A63H 27/10* (2006.01)

(52) U.S. Cl.
CPC ..... *A63H 27/10* (2013.01); *A63H 2027/1091* (2013.01)

(58) Field of Classification Search
CPC ..... A63H 2027/1091
See application file for complete search history.

(56) References Cited

U.S. PATENT DOCUMENTS 4,924,919 A * 5/1990 Oyler ..... A63H 27/10 141/10
4,974,393 A * 12/1990 Rich ..... A63H 27/10 141/10
5,033,256 A * 7/1991 Rupp ..... A63H 27/10 53/385.1
5,035,104 A * 7/1991 Helling ..... B65B 55/20 53/445
5,088,267 A * 2/1992 Gee ..... A63H 27/10 141/10
5,205,109 A * 4/1993 Conway ..... A63H 27/10 53/410
5,337,540 A * 8/1994 Carroll ..... A63H 27/10 53/469

(Continued)

FOREIGN PATENT DOCUMENTS

DE 3942485 A1 * 6/1991 ..... A63H 27/10

OTHER PUBLICATIONS

Translation DE-3942485-A1 (Year: 1991).*

*Primary Examiner* — Eugene L Kim
*Assistant Examiner* — Alyssa M Hylinski

(57) ABSTRACT

An electric squishy maker is provided. A cover shell is positioned in an inflation operation zone of a base, an inflation cavity for accommodating a flexible ball is formed between at least a portion of the inflation operation zone and an inner cavity of the cover shell, a negative pressure generating hole of the inflation operation zone is located within the range of the inflation cavity, a first opening and a convex ring on the first opening are provided on the cover shell at a position opposite to the inflation operation zone, and a negative pressure generating port of a negative pressure generating device is connected with the negative pressure generating hole through a tube. The electric squishy maker is easy to use and improves the decorative effect of inflated flexible balls.

4 Claims, 8 Drawing Sheets

(56) References Cited

U.S. PATENT DOCUMENTS

| | | | | | |
|---|---|---|---|---|---|
| 5,653,272 | A * | 8/1997 | McCaul | A63H 27/10 | 141/46 |
| 5,873,764 | A * | 2/1999 | Scherr | A63H 27/10 | 53/469 |
| 6,141,941 | A * | 11/2000 | Carroll | A63H 27/10 | 53/385.1 |
| 12,214,291 | B2 * | 2/2025 | Perrin | A63H 27/10 | |
| 2008/0085656 | A1 | 4/2008 | Boise | | |
| 2014/0096867 | A1 | 4/2014 | Cayton | | |
| 2020/0282321 | A1 | 9/2020 | Yuen | | |
| 2022/0387901 | A1 * | 12/2022 | Perrin | A63H 27/10 | |
| 2022/0410026 | A1 * | 12/2022 | Sacha | A63H 33/009 | |

* cited by examiner

ELECTRIC SQUISHY MAKER

TECHNICAL FIELD

The present invention belongs to the technical field of flexible ball inflation equipment, and in particular relates to an electric squishy maker.

BACKGROUND

At present, squishies are a type of ball toys that are inflated or filled with liquid in flexible balls. The flexible balls are usually made of silicone materials. The ball toys can be played by squeezing and kneading in the hands, and are usually purchased from toy stores or supermarkets. However, the squishies in the toy stores or supermarkets are premade, most of them are of the same style, and many types of squishies may have been played by children. Therefore, the squishies currently available in toy stores or supermarkets are less likely to arouse interest. In the case of being made by oneself, the flexible ball can be inflated by manually blowing air into the blowing port thereof with the mouth, but only a small amount of liquid and/or decorations can be stuffed into the flexible ball, causing the squishies to be less playful and less ornamental, so there is an urgent need to adapt a new way of making and playing with squishies.

SUMMARY

The present invention provides an electric squishy maker to solve the above-mentioned technical deficiencies.

The present invention provides an electric squishy maker, including: a base, where an inflation operation zone is provided on the base, and a negative pressure generating hole is provided on the inflation operation zone; a cover shell, where the cover shell is positioned in the inflation operation zone, an inflation cavity for accommodating a flexible ball is formed between at least a portion of the inflation operation zone and an inner cavity of the cover shell, the negative pressure generating hole is located within the range of the inflation cavity, a first opening is provided on the cover shell at a position opposite to the inflation operation zone, a convex ring is provided on the first opening along an edge thereof for positioning an inflated inflation port of the flexible ball, and the convex ring extends in an opposite direction to the inflation operation zone; and a negative pressure generating device, where a negative pressure generating port of the negative pressure generating device is connected with the negative pressure generating hole through a tube.

Here, the negative pressure generating device works continuously to make air pressure in the inflation cavity lower than an external air pressure, which promotes the air pressure to continuously enter a ball cavity of the flexible ball through the inflated inflation port on the flexible ball, so that the flexible ball is in an inflated state.

According to the electric squishy maker described above, the electric squishy maker further includes a bracket provided in the inflation cavity, the bracket includes a recessed portion suspended in the inflation cavity, the recessed portion is arranged in a hollow manner and opposite to the first opening, and a region above the recessed portion in the inflation cavity serves as an inflation position for flexible ball inflation.

According to the electric squishy maker described above, the inflation operation zone includes a boss, the cover shell is sleeved on the boss by a second opening thereof, a peripheral side surface of the boss is in contact with an inner wall of the cover shell, the inflation cavity is formed between a top surface of the boss and the inner cavity of the cover shell, and the negative pressure generating hole is arranged on the top surface of the boss.

According to the electric squishy maker described above, the inflation operation zone further includes a support surface continuously provided on the peripheral side of the boss, the support surface supports an end surface of the cover shell with the second opening, a side stop portion arranged continuously or at intervals is provided on the support surface at a position far from the boss, at least one first snap-in protrusion is provided on a side of the side stop portion facing the boss, a snap-in gap is formed between the first snap-in protrusion and the support surface, at least one second snap-in protrusion is provided on an outer wall of the cover shell at a position located between the side stop portion and the boss, and the second snap-in protrusion is fitted in the snap-in gap.

According to the electric squishy maker described above, the support surface includes an annular bottom surface and a soft annular ring, and the annular bottom surface is arranged to correspondingly overlap with the soft annular ring, so that a side of the soft annular ring facing the cover shell supports the end surface of the cover shell with the second opening and forms a snap-in gap with the first snap-in projection.

According to the electric squishy maker described above, the electric squishy maker further includes a sealing plug, and when the sealing plug is located in the convex ring, the sealing plug is at least partially wrapped by the inflation port of the inflated flexible ball.

According to the electric squishy maker described above, the electric squishy maker further includes an air outlet nozzle, the air outlet nozzle is mounted on the base, and an air outlet of the negative pressure generating device is connected with the air outlet nozzle.

According to the electric squishy maker described above, the bracket further includes a plurality of support racks provided on a peripheral side of the recessed portion and arranged in an annular array, and each of the support racks is placed on the top surface of the boss or on a step on the inner wall of the cover shell.

According to the electric squishy maker described above, a convex portion arranged continuously or at intervals is provided at an edge of the top surface of the boss or at a position close to the edge of the top surface of the boss, and a bottom surface of each of the support racks is in contact with a top surface of the convex portion so that the bracket is arranged on the convex portion.

According to the electric squishy maker described above, the bottom surface of the at least one support rack is provided with a stopper extending in the direction of the boss, a concave portion is formed between a side wall of the stopper and the bottom surface of the support rack, and the convex portion is fitted in the concave portion, so that the stopper and the convex portion are mutually limited.

According to the electric squishy maker described above, the top surface of the boss has a depression which is depressed towards a bottom portion of the base.

According to the electric squishy maker described above, an upper end opening of the convex ring is formed with an outwardly expanding annular portion, and the annular portion is raised on an outer side wall of the convex ring.

According to the electric squishy maker described above, the negative pressure generating hole is arranged at the position of the depression, and an upper surface of the depression is formed with a plurality of airflow guide grooves arranged in an annular array around the negative pressure generating hole.

According to the electric squishy maker described above, a mounting cavity is provided in the base, and the negative pressure generating device is mounted in the mounting cavity.

The electric squishy maker according to the present invention allows a flexible ball to be placed into an inflation cavity, then inflates and turns up an inflation port of the flexible ball, and inverts the inflation port on a convex ring by means of the elasticity of the inflation port itself; at this time, a negative pressure generating device works continuously to make air pressure in the inflation cavity lower than an external air pressure, which promotes the air pressure to continuously enter a ball cavity of the flexible ball through the inflated inflation port on the flexible ball, so that the flexible ball is in an inflated state; in this case, decorations or liquids can be stuffed into the flexible ball through the inflated inflation port until the decorations or liquids fill the ball cavity in large quantities or in whole, and then the inflation port is sealed with a sealing plug; and finally a cover shell is detached from a boss to take out the inflated flexible ball, thus completing the making of a squishy. The flexible ball inflation method realized by the electric squishy maker facilitates use, increases the amount of decorations or liquids that can be stuffed into the flexible ball to improve the decorative effect of the inflated flexible ball, and further allows a variety of decorations or liquids to be stuffed into the ball cavity according to needs, thereby enhancing the interest in playing with the squishy.

Figure 1:
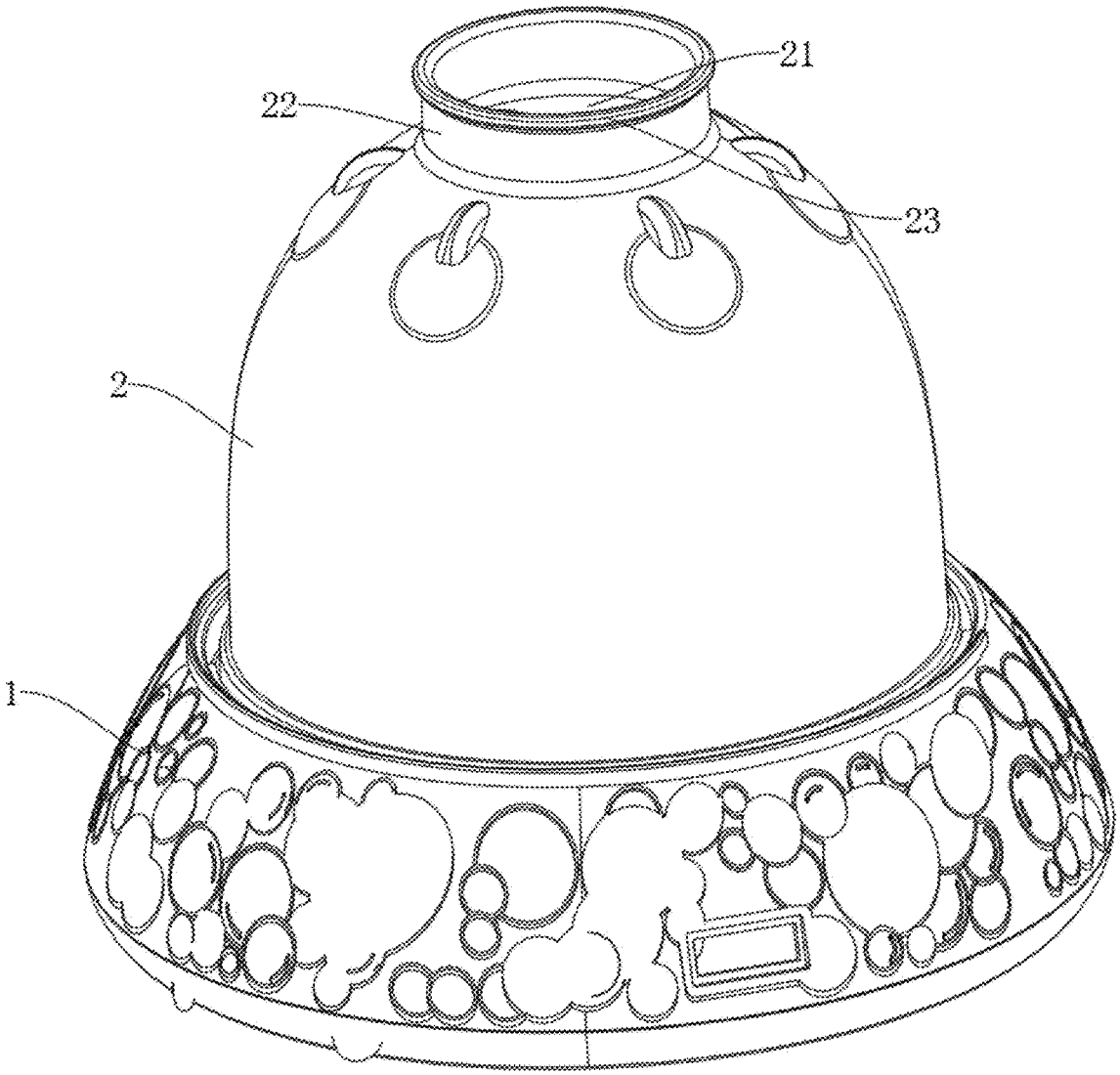
FIG. 1 is a schematic diagram of an overall structure.

Description of reference numerals in the drawings: 1. base; 2. cover shell; 3. negative pressure generating device; 4. bracket; 11. inflation operation zone; 12. upper half shell; 13. lower half shell; 21. first opening; 22. convex ring; 23. annular portion; 24. second snap-in protrusion; 25. second opening; 41. recessed portion; 42. support rack; 43. stopper; 44. concave portion; 111. boss; 112. support surface; 113. side stop portion; 114. depression; 115. convex portion; 116. negative pressure generating hole; 117. airflow guide groove; 118. first snap-in protrusion; 119. snap-in gap; 120. air outlet nozzle; 121. soft annular ring; 122. annular bottom surface; 123. tube body; 411. intermediate hole; 412. side hole; 5. inflation cavity; 6. sealing plug; and 61. annular protrusion.

DESCRIPTION OF THE EMBODIMENTS

In order to make those skilled in the art better understand the present invention and thereby define the scope of the present invention more clearly, the present invention is described below in detail with respect to some specific embodiments of the present invention. It should be noted that the following description only relates to some specific embodiments of the inventive concept and are only part of the embodiments of the present invention, specific and direct descriptions of relevant structures are merely for the convenience of understanding the present invention, and the specific features do not, of course, directly limit the implementation scope of the present invention. Conventional choices and alternatives made by those skilled in the art under the guidance of the inventive concept should be considered within the scope of the present invention.

Figure 2:
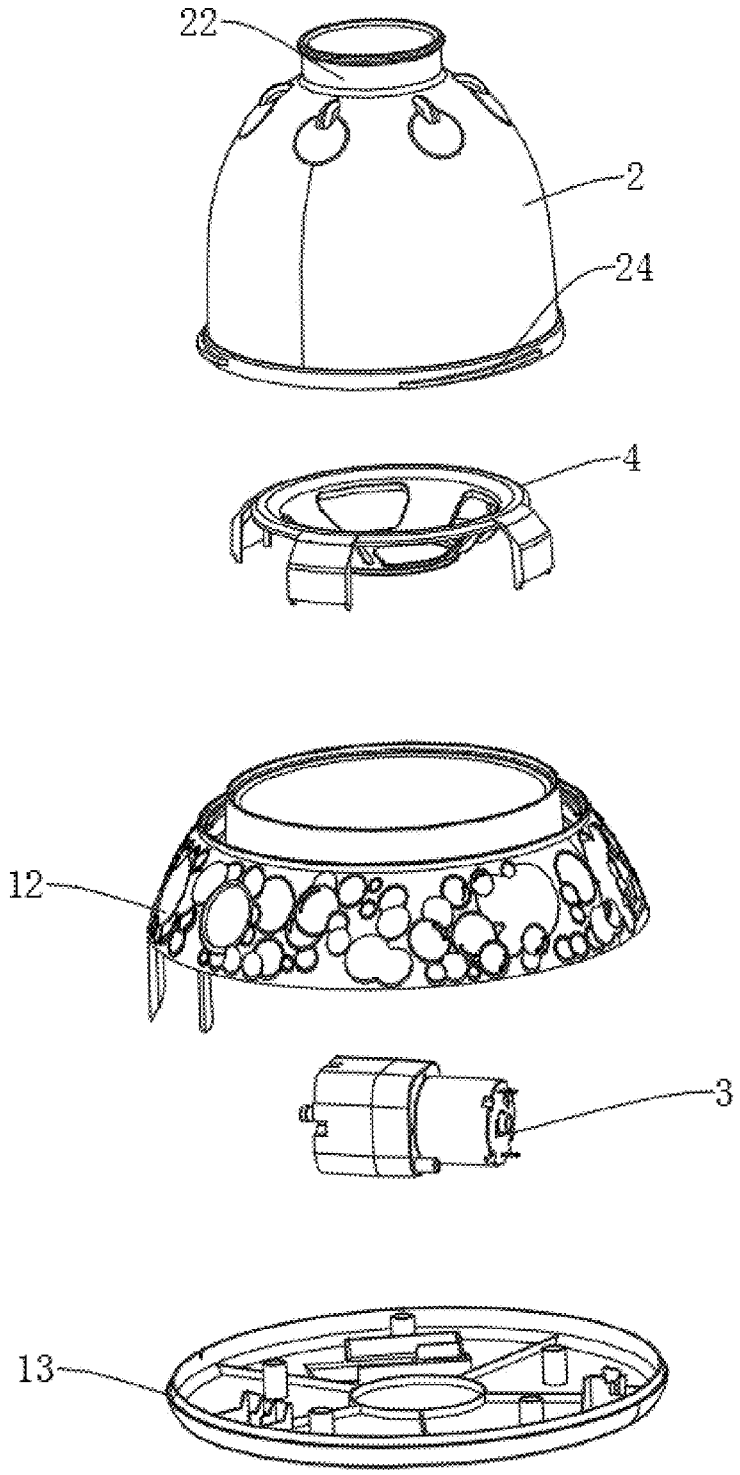
FIG. 2 is an exploded view of the overall structure.
Figure 3:
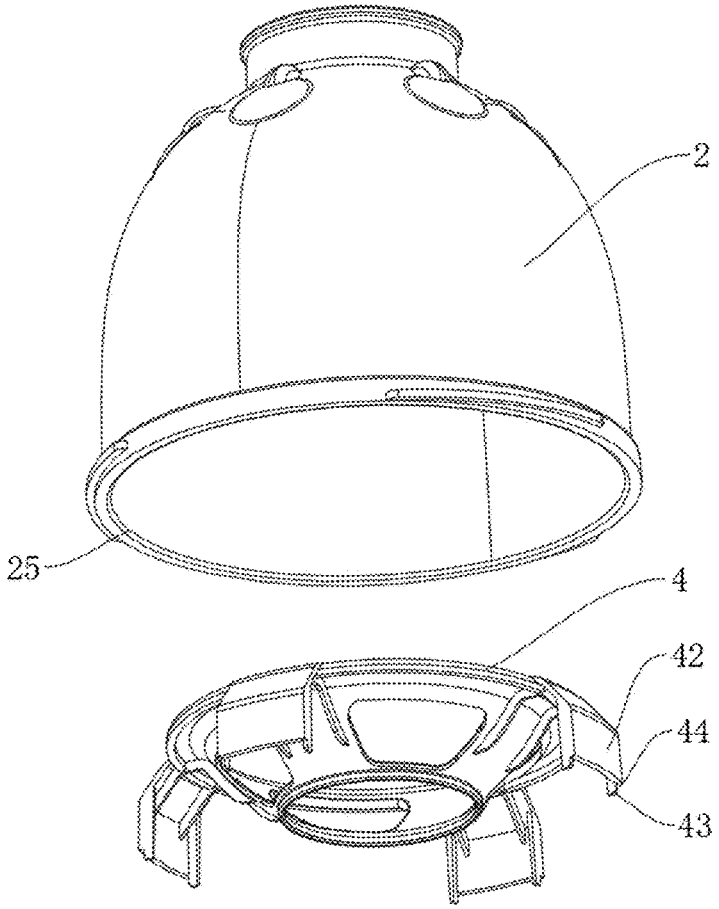
FIG. 3 is an exploded view of a cover shell and a bracket separated from each other.
Figure 4:
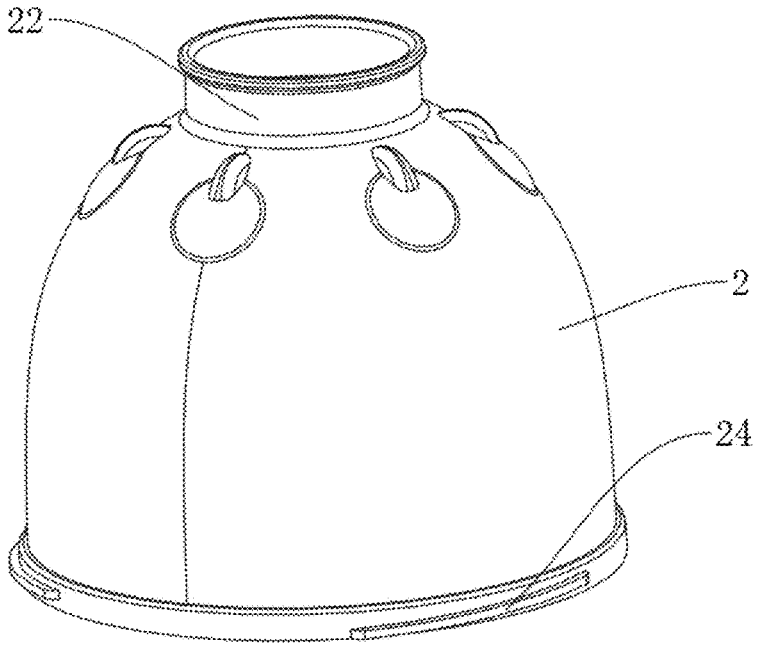
FIG. 4 is a schematic structural diagram of the cover shell.
Figure 5:
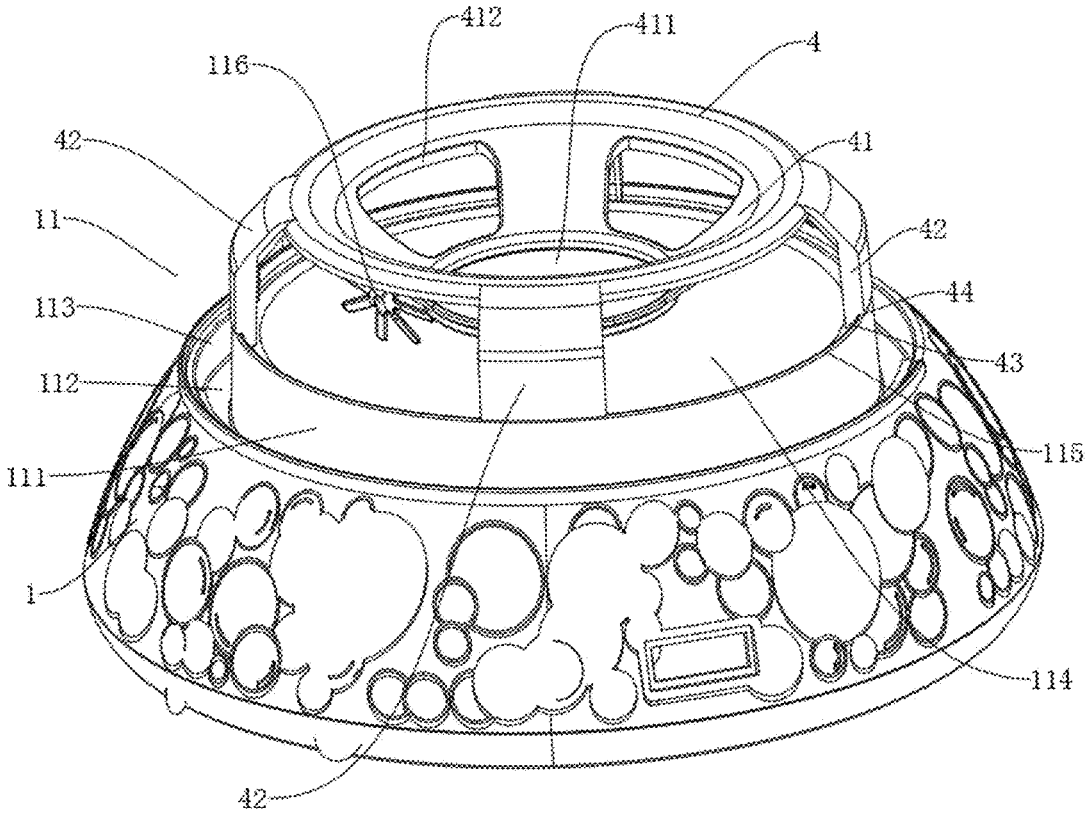
FIG. 5 is a schematic structural diagram of the bracket combined with a base.
Figure 6:
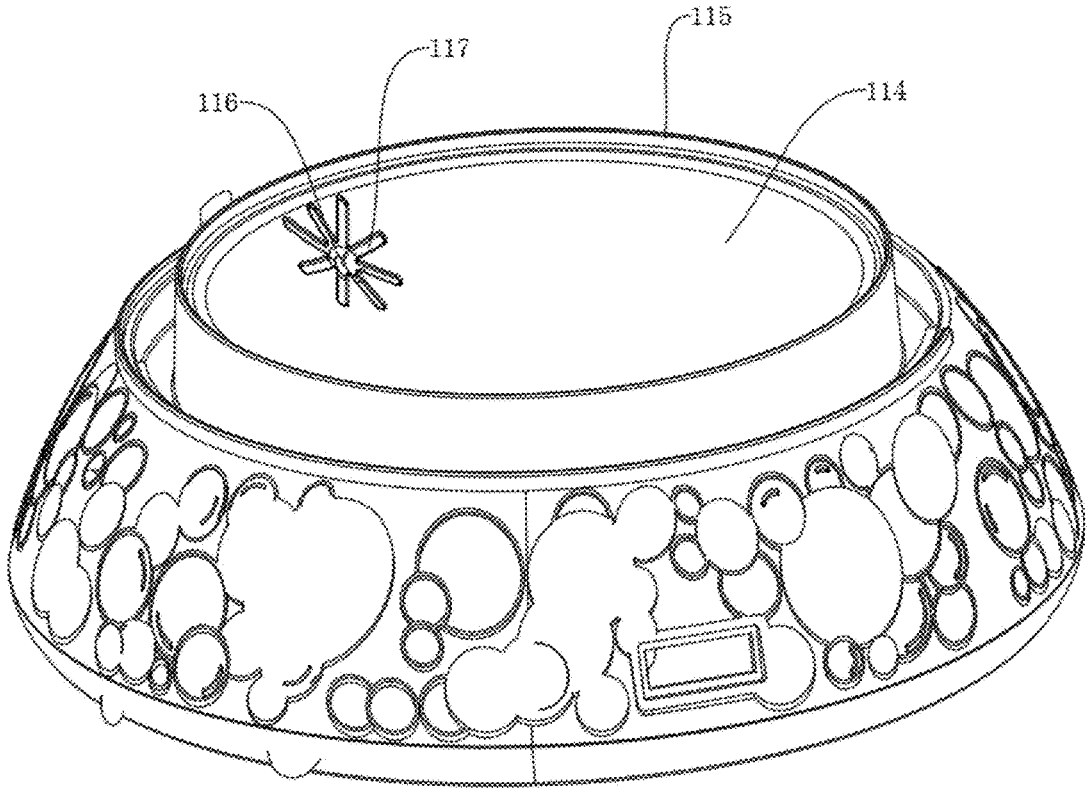
FIG. 6 is a first schematic structural diagram of the base.
Figure 7:
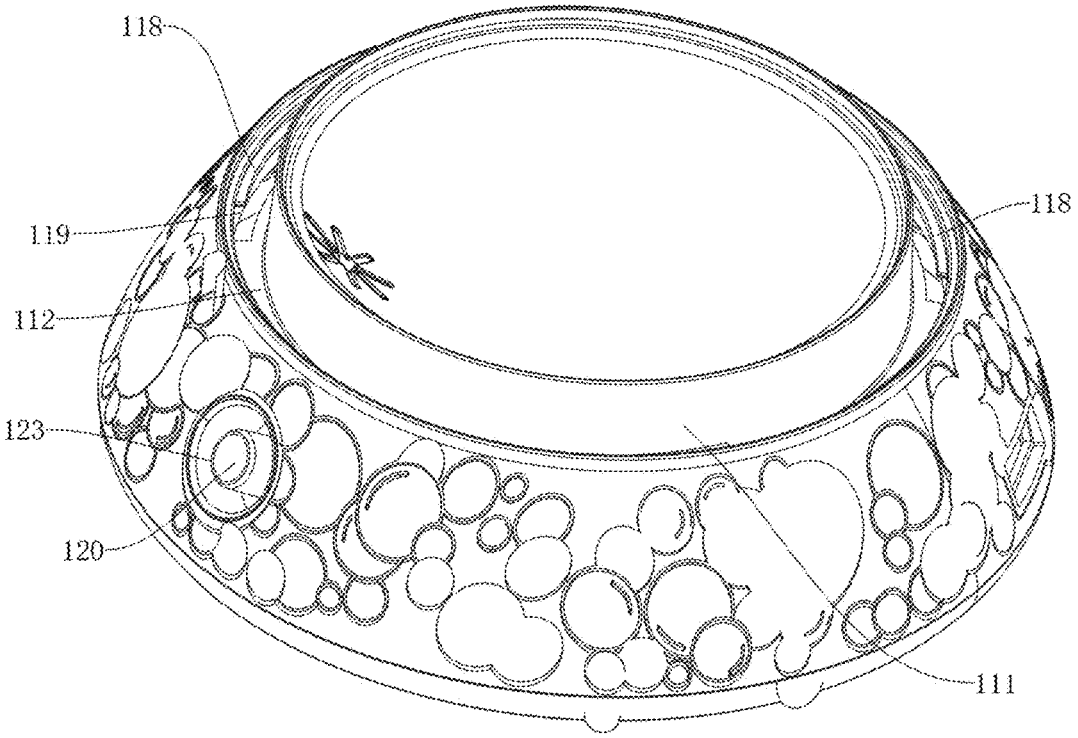
FIG. 7 is a second schematic structural diagram of the base.
Figure 8:
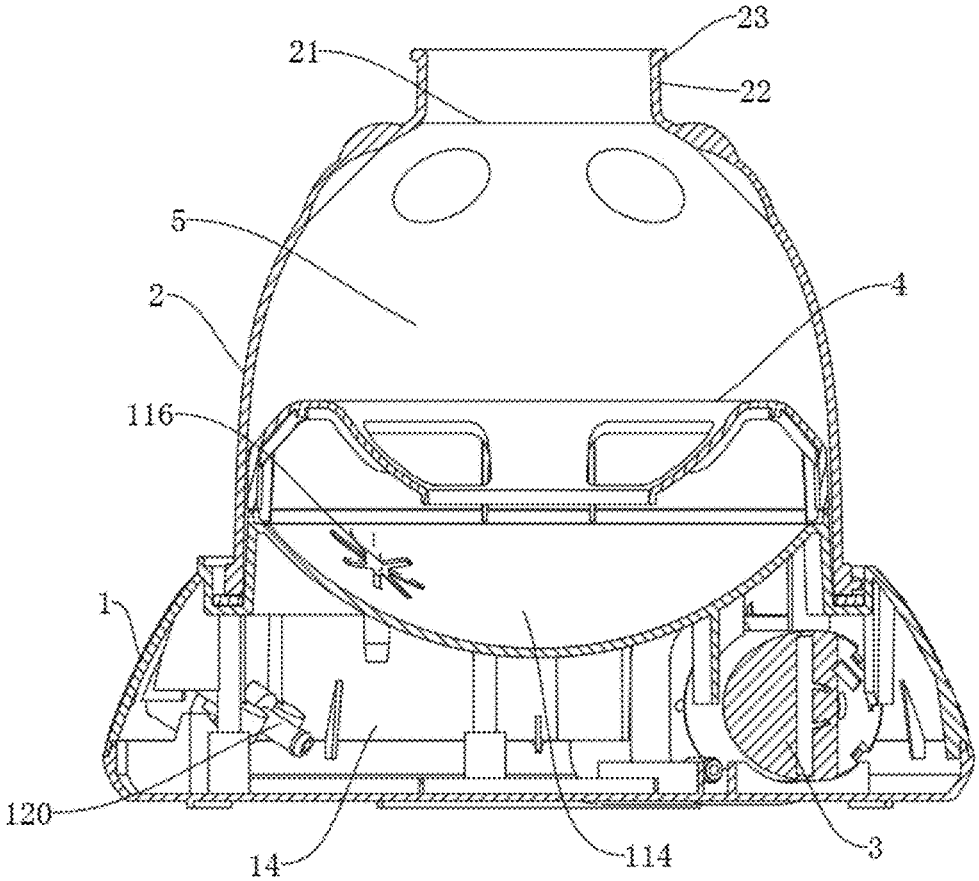
FIG. 8 is a cross-sectional view of the overall structure.
Figure 9:
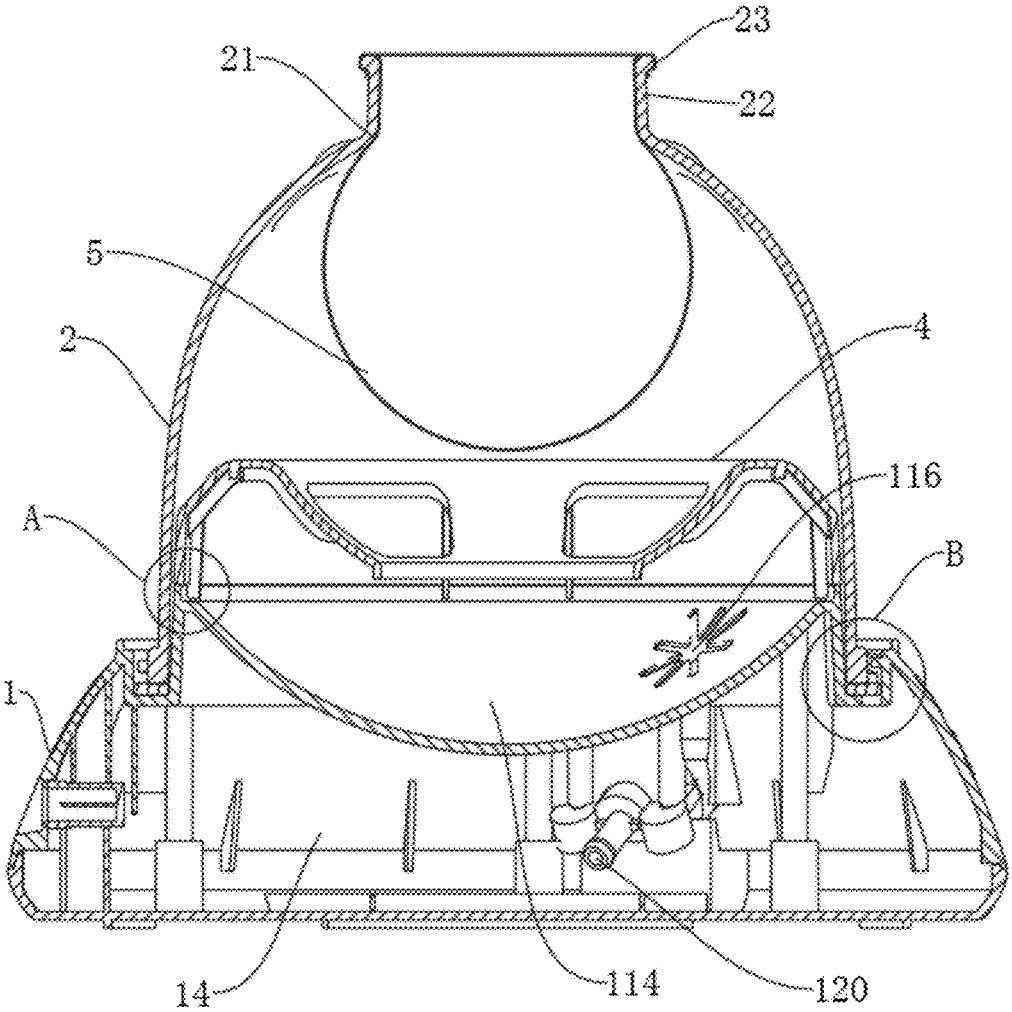
FIG. 9 is a schematic structural diagram of an electric squishy maker with a flexible ball mounted thereon.
Figure 10:
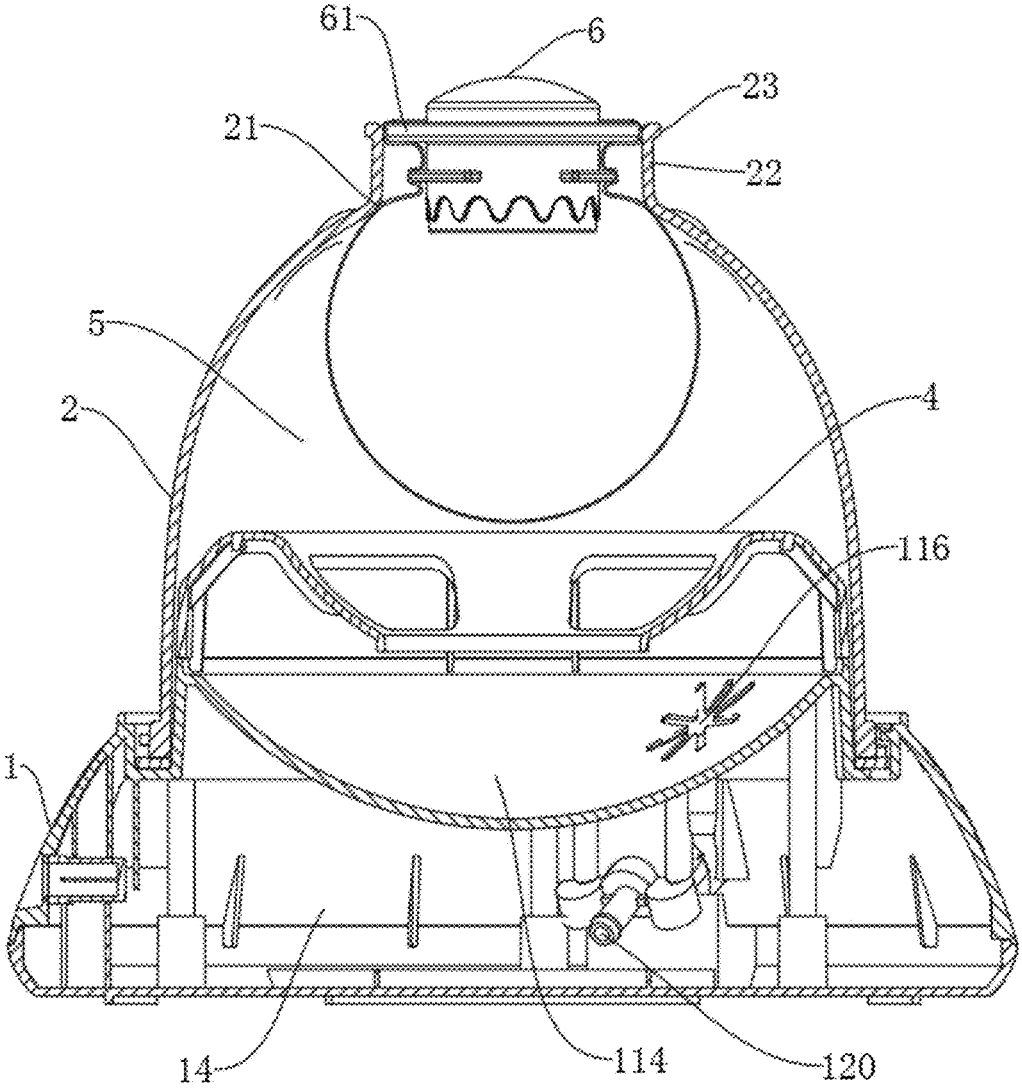
FIG. 10 is a schematic structural diagram of an inflation port of the flexible ball on the electric squishy maker with a sealing plug inserted therein.
Figure 11:
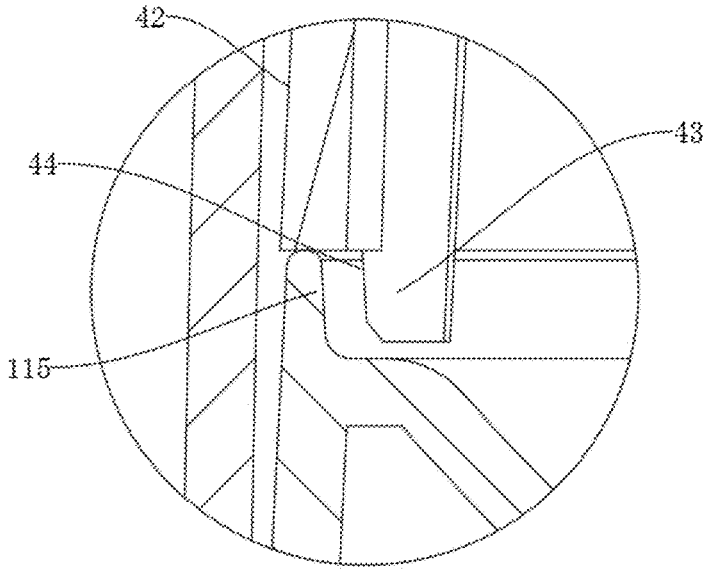
FIG. 11 is an enlarged view of A.
Figure 12:
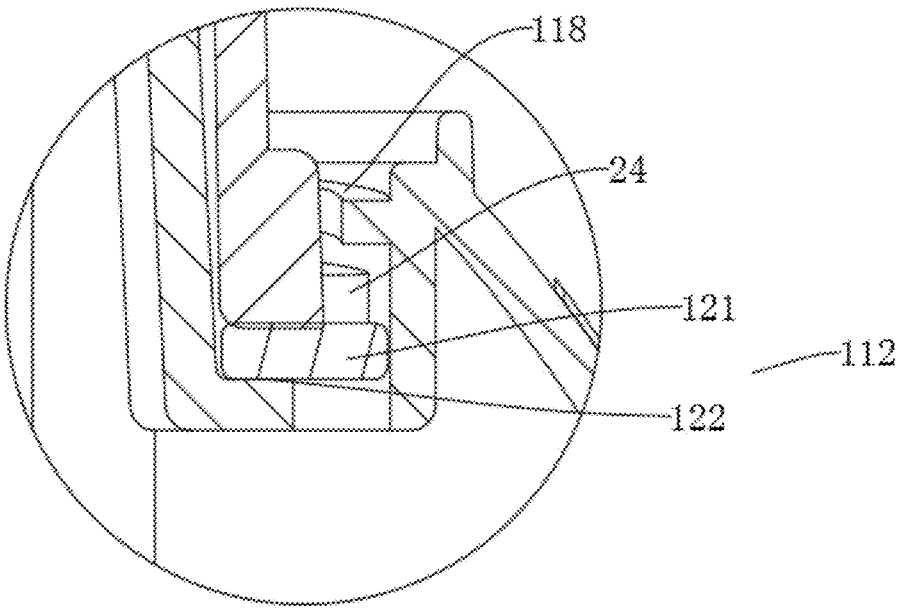
FIG. 12 is an enlarged view of B.

As shown in FIGS. 1-9, an electric squishy maker described in the present embodiment includes a base 1, a cover shell 2 and a negative pressure generating device 3, where an inflation operation zone 11 is provided on the base 1, a negative pressure generating hole 116 is provided on the inflation operation zone 11, the negative pressure generating hole 116 may be round or square or other shape, and the negative pressure generating hole 116 extends downward to form a connecting tube; the cover shell 2 is positioned in the inflation operation zone 11, an inflation cavity 5 for accommodating a flexible ball is formed between at least a portion of the inflation operation zone 11 and an inner cavity of the cover shell 2, the negative pressure generating hole 116 is located within the range of the inflation cavity, a first opening 21 provided on the cover shell 2 at a position opposite to the inflation operation zone 11, a convex ring 22 is provided on the first opening 21 along an edge thereof for positioning an inflated inflation port of the flexible ball, and the convex ring 22 extends in an opposite direction to the inflation operation zone 11; and a mounting cavity is provided in the base 1, the negative pressure generating device 3 is mounted in the mounting cavity, a negative pressure generating port of the negative pressure generating device 3 is connected with the negative pressure generating hole 116 through a tube, the negative pressure generating device 3 may be an air pump and be powered by a battery to start, the cover shell 2 and the base 1 are generally made of plastic materials, and the base 1 is composed of an upper half shell 12 and a lower half shell 13 spliced and fixed with each other.

Here, the upper end opening of the convex ring 22 is formed with an outwardly expanding annular portion 23, and the annular portion 23 is raised on an outer side wall of the convex ring 22, so that when the flexible ball is put into the inflation cavity, the inflation port of the flexible ball is inflated and turned up and then upside down on the convex ring 22 by means of the elasticity of the inflation port itself, and the annular portion snaps the turned-up inflation port, and then the negative pressure generating device 3 works continuously to make air pressure in the inflation cavity lower than an external air pressure, which promotes the air pressure to continuously enter a ball cavity of the flexible ball through the inflated inflation port on the flexible ball, so that the flexible ball is in an inflated state.

In the present embodiment, the electric squishy maker further includes a bracket 4 provided in the inflation cavity, the bracket 4 includes a recessed portion 41 suspended in the inflation cavity, an intermediate hole 411 and a plurality of side holes 412 located on a peripheral side of the intermediate hole 411 are provided on the recessed portion 41 so that the recessed portion 41 is arranged in a hollow manner, and the recessed portion 41 is arranged opposite to the first opening 21, and a region above the recessed portion 41 in the inflation cavity serves as an inflation position for flexible ball inflation; where the recessed portion 41 is provided to mainly support the inflated flexible ball to prevent detachment of the inflation port from the convex ring 22 due to drooping of the flexible ball, especially after a liquid is injected into the flexible ball body; and the recessed portion 41 is arranged in a hollow manner, so that negative pressure is more easily generated in the inflation cavity, improving the effect of use.

Further, the bracket 4 further includes a plurality of support racks 42 provided on a peripheral side of the recessed portion 41 and arranged in an annular array, and each of the support racks 42 is placed on the top surface of the boss 111 or on a step on the inner wall of the cover shell 2. The generally preferred technical solution for the two ways of mounting the bracket 4 in the inflation cavity is as follows: a convex portion 115 arranged continuously or at intervals is provided at an edge of the top surface of the boss 111 or at a position close to the edge of the top surface, and a bottom surface of each of the support racks 42 is in contact with a top surface of the convex portion 115 so that the bracket 4 is arranged on the convex portion 115; in order to make the mounting of the bracket 4 more stable, the bottom surface of the at least one support rack 42 is provided with a stopper 43 extending in the direction of the boss 111, a concave portion 44 is formed between a side wall of the stopper 43 and the bottom surface of the support rack 42, and the convex portion 115 is fitted in the concave portion 44, so that the stopper 43 and the convex portion 115 are mutually limited, and the convex portion 115 is generally arranged in an annular shape.

In the present embodiment, the inflation operation zone 11 includes the boss 111, the boss 111 can be a cylindrical boss or other polygonal boss, the cover shell 2 is sleeved on the boss 111 by a second opening 25 thereof, a peripheral side surface of the boss 111 is in contact with the inner wall of the cover shell 2, the inflation cavity is formed between the top surface of the boss 111 and the inner cavity of the cover shell 2, and the negative pressure generating hole 116 is arranged on the top surface of the boss 111. This structural arrangement enables the cover shell 2 to be detachably mounted on the base 1.

Preferably, the inflation operation zone 11 further includes a support surface 112 continuously provided on the peripheral side of the boss 111, the support surface 112 supports an end surface with the second opening 25 on the cover shell 2, a side stop portion 113 arranged continuously or at intervals is provided on the support surface 112 at a position far from the boss 111, at least one first snap-in protrusion 118 is provided on a side of the side stop portion 113 facing the boss 111, a snap-in gap 119 is formed between the first snap-in protrusion 118 and the support surface 112, at least one second snap-in protrusion 24 is provided on an outer wall of the cover shell 2 at a position located between the side stop portion 113 and the boss 111, and the second snap-in protrusion 24 is fitted in the snap-in gap 119. This structural arrangement allows snap-in mounting of the cover shell 2 on the base 1, thus preventing the cover shell 2 from detaching from the base 1 during use of the electric squishy maker; where the side stop portion 113 preferably adopts an annular structure, and preferably three first snap-in protrusions 118 and second snap-in protrusions 24 are provided to enhance the stability of the snap-in mounting, but two first snap-in protrusions and second snap-in protrusions also can be provided, and the second snap-in protrusion 24 is inclined in a spiral shape.

In the present embodiment, the top surface of the boss 111 has a depression 114 which is depressed towards a bottom portion of the base 1, and the depression 114 is arranged in a spherical shape so that an upper surface of the depression 114 is a concave spherical surface.

Preferably, the negative pressure generating hole 116 is arranged at the position of the depression 114, and the upper surface of the depression 114 is formed with a plurality of airflow guide grooves 117 arranged in an annular array around the negative pressure generating hole 116, and this structural arrangement enables airflow in the inflation cavity to be more easily drawn away by the negative pressure generating device 3.

Further, the support surface 112 includes an annular bottom surface 122 and a soft annular ring 121, and the annular bottom surface 122 is arranged to correspondingly overlap with the soft annular ring 121, so that a side of the soft annular ring 121 facing the cover shell 2 supports the end face of the cover shell 2 with the second opening 25 for support, and the snap-in gap 119 is formed between a side surface of the soft annular ring 121 facing the cover shell 2 and the first snap-in protrusion 118. When a lower end face of the cover shell 2 is in contact with an upper side face of the soft annular ring 121 and then rotates, the second snap-in protrusion 24 rotates into the snap-in gap 119, so that a highest part of the second snap-in protrusion 24 abuts against a lower side face of the first snap-in protrusion 118, and pressure is applied to the soft annular ring, so that the lower end face of the cover shell 2 is in close contact with the upper side face of the soft annular ring 121, so that the cover shell 2 is mounted on the base 1 in a sealing manner.

In the present embodiment, the electric squishy maker further includes a sealing plug 6; when the sealing plug 6 is located in the convex ring 22, the sealing plug 6 is at least partially wrapped by the inflation port of the inflated flexible ball; when wrapped, a tightening ring at the inflation port of the flexible ball is located on an upper side surface of an annular protrusion 61, thus preventing the sealing plug from separating from the flexible ball and sealing the inflated flexible ball to prevent the liquid in the flexible ball from flowing out; at the same time, due to elasticity of the flexible ball, a position between the tightening ring at the inflation port of the flexible ball and the inflated flexible ball is tightly bound to a surface of the sealing plug and the protrusions, and then the cover shell 2 rotates in an opposite direction to cause the second snap-in protrusion 24 to detach from the snap-in gap 119, and then an upward force is applied to the cover shell 2 to detach the inflated flexible ball from the boss 111, at this time, the inflated flexible ball may be stuck in the convex ring 22 due to the sealing plug 6, or the inflation port of the inflated flexible ball may be separated from the convex ring 22 together with the sealing plug 6, and the inflated flexible ball may fall into the recessed portion 41 of the bracket 4, and then the inflated flexible ball may be removed from the bracket 4 or the inflation port of the flexible ball in the cover shell 2 together with the sealing plug 6 may be detached from the convex ring and removed.

In the present embodiment, the electric squishy maker further includes an air outlet nozzle 120, the air outlet nozzle 120 is mounted on the base 1, and an air outlet of the negative pressure generating device 3 is connected with the air outlet nozzle through a tube, where the inflation port of the flexible ball can be sleeved on a tube body 123 of the air outlet nozzle 120, and then during operation of the negative pressure generating device 3, air is discharged from the air outlet to cause air to be discharged from the tube body 123 of the air outlet nozzle 120, prompting the flexible ball to be inflated.

What is claimed is:

1. An electric squishy maker, comprising:

a base, an inflation operation zone being provided on the base, and a negative pressure generating hole being provided on the inflation operation zone;

a cover shell, the cover shell being positioned in the inflation operation zone, an inflation cavity for accommodating a flexible ball being formed between at least a portion of the inflation operation zone and an inner cavity of the cover shell, a first opening being provided on the cover shell at a position opposite to the inflation operation zone, a convex ring being provided on the first opening along an edge thereof for positioning an inflated inflation port of the flexible ball, and the convex ring extending in an opposite direction to the inflation operation zone;

a negative pressure generating device, a negative pressure generating port of the negative pressure generating device being connected with the negative pressure generating hole through a tube;

wherein the negative pressure generating device works continuously to make air pressure in the inflation cavity lower than an external air pressure, which promotes the external air pressure to continuously enter a ball cavity of the flexible ball through the inflated inflation port on the flexible ball, so that the flexible ball is in an inflated state;

wherein the inflation operation zone comprises a boss and a support surface continuously provided on a peripheral side of the boss, the cover shell is sleeved on the boss by a second opening thereof, the support surface is in contact with an inner wall of the cover shell, the inflation cavity is formed between a top surface of the boss and the inner cavity of the cover shell, and the negative pressure generating hole is arranged on the top surface of the boss;

the support surface supports an end surface of the cover shell with the second opening, a side stop portion arranged continuously or at intervals is provided on the support surface at a position spaced from the boss, at least one first snap-in protrusion is provided on a side of the side stop portion facing the boss, a snap-in gap is formed between the first snap-in protrusion and the support surface, at least one second snap-in protrusion is provided on an outer wall of the cover shell at a position located between the side stop portion and the boss, and the second snap-in protrusion is fitted in the snap-in gap; and a bracket provided in the inflation cavity, wherein the bracket comprises a recessed portion suspended in the inflation cavity, the recessed portion is arranged in a hollow manner and opposite to the first opening, and a region above the recessed portion in the inflation cavity serves as an inflation position for flexible ball inflation.

2. The electric squishy maker according to claim 1, wherein the bracket further comprises a plurality of support racks provided on a peripheral side of the recessed portion and arranged in an annular array, and each of the support racks is placed on the top surface of the boss or on a step on the inner wall of the cover shell.

3. The electric squishy maker according to claim 2, wherein a convex portion arranged continuously or at intervals is provided at an edge of the top surface of the boss or at a position close to the edge of the top surface of the boss, and a bottom surface of each of the support racks is in contact with a top surface of the convex portion so that the bracket is arranged on the convex portion.

4. The electric squishy maker according to claim 3, wherein the bottom surface of the at least one support rack is provided with a stopper extending in the direction of the boss, a concave portion is formed between a side wall of the stopper and the bottom surface of the support rack, and the convex portion is fitted in the concave portion, so that the stopper and the convex portion are mutually limited.

* * * * *